United States Patent [19]

Cagle

[11] 4,154,147

[45] May 15, 1979

[54] PRESS UNLOADER WITH DEFROST AND WATER DRAIN VALVE

[75] Inventor: Harlan R. Cagle, Cheboygan, Mich.

[73] Assignee: Sahlin International, Inc., Troy, Mich.

[21] Appl. No.: 806,262

[22] Filed: Jun. 10, 1977

[51] Int. Cl.[2] ..... F01B 23/00; F15B 13/04

[52] U.S. Cl. ..... 91/55; 91/404; 91/441

[58] Field of Search ..... 91/441, 55, 404

[56] References Cited

U.S. PATENT DOCUMENTS

| | | | |
|---|---|---|---|
| 707,452 | 8/1902 | Schwend | 91/404 |
| 926,260 | 6/1909 | Klein | 91/335 |
| 2,805,447 | 9/1957 | Voges | 91/441 |
| 2,912,962 | 11/1959 | Kindl | 91/441 |
| 3,963,383 | 6/1976 | Hill | 91/306 |

*Primary Examiner*—Paul E. Maslousky

*Attorney, Agent, or Firm*—Harness, Dickey & Pierce

[57] ABSTRACT

A defrost and water drain valve suitable for use with air cylinders, such as used to furnish power to material handling equipment, is connected to receive air from the exhaust side of the piston and direct this air against the inlet end of the cylinder and is constructed so that it can also automatically function to permit drainage of condensed water in the cylinder. The valve includes means to control flow to and from the exhaust side of the piston and the use of its features in a flow control valve and a check valve is also disclosed.

8 Claims, 13 Drawing Figures

PRESS UNLOADER WITH DEFROST AND WATER DRAIN VALVE

BACKGROUND OF THE INVENTION

Press unloading devices of the type shown in U.S. Pat. Nos. 2,609,776 and 3,206,040 are used in the mass manufacture of automobiles to load and unload large metal panels in presses. One known device of this type operates at a speed of approximately 19 strokes per minute and is driven by compressed air which acts upwardly on a piston in a single acting vertically arranged cylinder. The rapid expansion of air due to the speed of operation results in a frosting and icing condition at the inlet end of the cylinder which combined with condensation of water in the air creates a problem with respect to the speed of operation of the press unloader.

BRIEF SUMMARY OF THE INVENTION

It is the purpose of this invention to provide a means to reduce or eliminate the formation of frost at the inlet end of an air cylinder. It is also a purpose of the invention to provide a means to automatically remove water condensate from an air cylinder.

The invention accomplishes these and other purposes by means of a valve that is connected to the bottom of a vertically arranged cylinder so that water in the cylinder can flow by gravity into the valve, its flow through the valve and release to the outside being controlled by a plunger which is moved by the cylinder piston rod. The valve is connected through a conduit to the exhaust side of the cylinder so that the hot exhaust air flows through the valve and is directed by it against the metal of the compressed air inlet manifold to heat it and prevent or reduce frosting. The valve contains a suitable valve member that is seated to block flow of heated exhaust gas out of the valve except through the aforementioned ports and moves away from the seat on the return stroke of the piston thereby permitting a reverse flow of air through the conduit to the top of the piston.

Another purpose of the invention is to use features of the defrost and water drain valve in a flow control valve and in a check valve. A preferred arrangement for accomplishing this purpose is a construction wherein basic parts of the flow control valve construction may be used with only a minor modification in the check valve construction.

DESCRIPTION OF THE INVENTION

Figure 1:
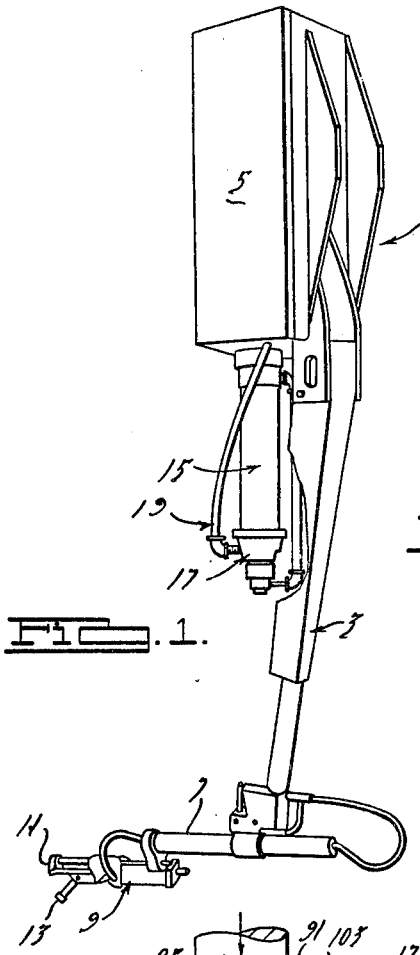
FIG. 1 is a perspective view of a press unloader manufactured by the assignee of this invention which has a vertical cylinder with a defrost and water drain valve arrangement according to the present invention attached to it.

A press unloader 1 of a type available on the open market and described generally in U.S. Pat. Nos. 2,609,776 and 3,206,040 has a vertically arranged swinging arm 3 which is hinged at its upper end to a frame 5 and which carries at its lower end a horizontally arranged guide 7 which carries a panel engaging mechanism 9 that includes upper and lower jaws 11 and 13. Suitable compressed air driven cylinders responding to suitable control valves and mechanisms operate the arm 3 and the jaws 11 and 13 in a manner that simulates the flexibility of a human being, thereby enabling the device 1 to pick up and move horizontally and vertically large panels that are much too heavy for direct human handling.

Figure 2:
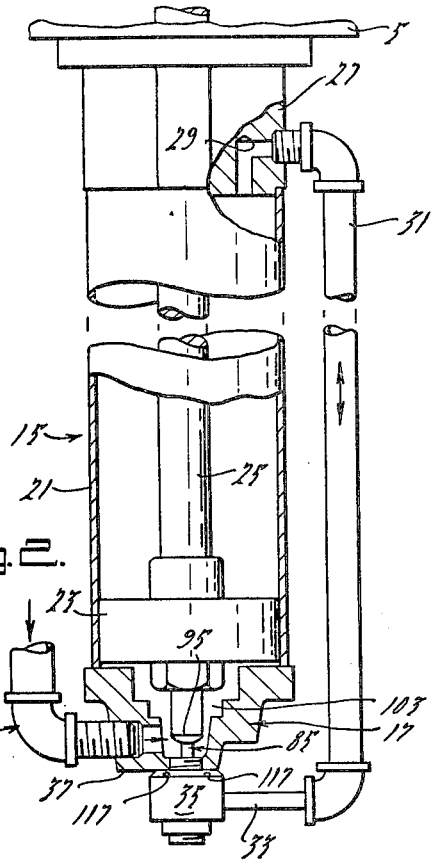
FIG. 2 is an enlarged view partly in section and broken away of the vertical cylinder shown in FIG. 1.

The power means for the device 1 includes a vertically arranged, single acting, gravity return, air cylinder 15 that has an inlet cap 17 providing a compressed air inlet mainfold at its bottom end to which is attached a conduit means 19 carrying compressed air to the manifold. As seen in FIG. 2, the air cylinder 15 has a housing 21 that contains a piston 23 that is mounted on a piston rod means 25 that extends vertically upwardly into the frame 5 and downwardly below the piston. The air cylinder 15 has an exhaust end cap 27 with an air flow passage 29 that communicates with an exhaust air conduit means 31. The other end of the conduit means 31 from the cap 27 includes a conduit section 33 that connects to the defrost and water drain valve assembly 35 of this invention which is mounted against the bottom face 37 of the inlet air manifold 17.

The valve assembly 35 includes a housing 39 that has a substantially cylindrical valve body 41 with an inner surface 43 on which is seated the enlarged cylinder end 45 of a spool 47 contained within the body 41. The spool 47 has a portion 49 extending over a substantial part of its length which is reduced in diameter to provide an annular chamber 51 between the spool and the valve body surface 43. A pipe threaded opening 53 in the wall of the body 41 opens into the chamber 51 and serves to receive the pipe threaded end of the conduit section 33. Located below the threaded opening 53 is a radial or horizontal annular downwardly facing shoulder 55 in the body 41 that is formed between the wall 43 and an enlarged cylindrical wall section 57 at the bottom end of the body. The spool 47 has a tapered annular shoulder 59, preferably extending on an angle of 45°, which joins the reduced diameter section 49 and a bottom section 61 which is preferably of the same outer diameter as the spool section 45. Thus, there is a substantial annular opening 63 between the spool section 61 and the body section 57. A valve member such as axially movable "O" ring 65, formed of suitable and conventional resilient material and having an outer diameter which is substantially the same as the diameter of body section 57, is in the small chamber 67 located between the shoulder 55 on the body and the shoulder 59 on the spool. The "O" ring 65 has a large enough cross section to enable it to seat against the tapered surface 59 without being extruded through the annular opening 63.

The inner diameter of the spool 47 is threaded throughout its length and it threadably receives an externally threaded drain tube 69. The tube 69 has a top end portion 71 that projects through an opening 73 in a top wall 75 of the body 39, being sealed at this point by an "O" ring 77. The top end 71 of the tube 69 threads into an aperture 79 in the bottom wall 81 of the air inlet mainfold 17. Since the drain tube 69 has a threaded connection with the inlet air cap 17 as well as with the spool 47, it serves as a means for attaching the valve 35 to the cap 17 at the bottom of the cylinder 15. The enlarged upper end of the spool 45 bears against the inside face of the end wall 75 of the body 39 to press the upper face of the end wall against the bottom surface 37 of the end cap.

Figure 5:
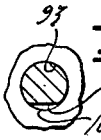
FIG. 5 is a cross section along the line 5—5 of FIG. 3.
Figure 4:
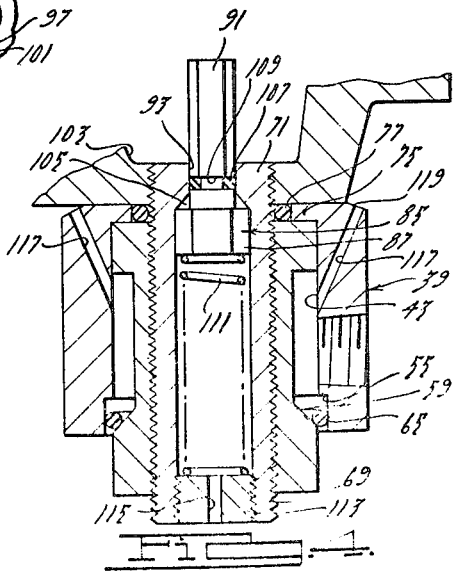
FIG. 4 is a view similar to FIG. 3 but showing the defrost and drain valve in a different stage of operation wherein the piston is up and the valve is sealed against incoming air or water condensate and against outflow of hot cylinder exhaust gas except through ports that are directed toward the compressed air inlet manifold.
Figure 6:
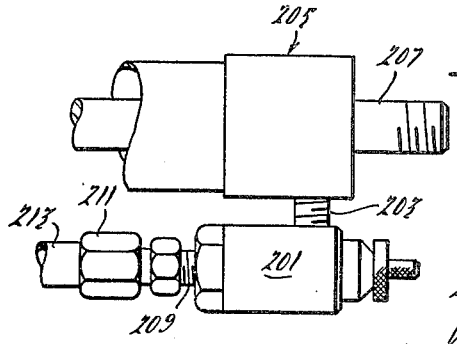
FIG. 6 is a side elevation of a cylinder horizontally arranged with a flow control valve embodying the invention secured by a conduit to the exhaust port of the cylinder to provide means to regulate the rate of piston movement.

A drain plunger 85 has an enlarged bottom end 87 that fits the inside wall 89 of the drain tube 69. The plunger 85 has a stem portion 91 that extends vertically from the enlarged portion 87 and passes through a cylindrical section 93 of circular cross section in the top end 71 of the tube 69. The top end of the stem 91 has a one way connection or abutment-type engagement with the bottom end 95 of the piston rod 25. Along most of the length of the stem 91 and the full length of the head 87 of the plunger 85 are formed flat surfaces 97 and 99, respectively. Since the flat surface 97 passes through a cylindrical portion 93 of circular cross section, there is a small opening 101 (FIG. 5) that connects the space 103 inside of the end cap 17 with the variable space 105 between the plunger head 87 and the top of the drain tube 69. This connection may be sealed off, however, by means of an "O" ring 107 that is seated in a groove 109 in the stem 91 at a vertical location as seen in FIG. 4 which dictates that it will be within the cylindrical section 93 when the piston rod 25 is out of contact with the top end of the stem 91. In this condition a coil spring 111 that is confined within the drain tube 69 between the bottom of the plunger head 87 and the top of a closure plug 113, which is threaded into the bottom end of the drain tube 69, forces the plunger to the top of the drain tube 69. It is evident that the flat 99 on the plunger head will at all times provide an opening connecting the top of the head (i.e., chamber 105) to the bottom of the head (i.e., the condensate collecting chamber space within drain tube 69) since the cooperating wall 89 of the drain tube is of a circular cross section. The bottom part of the drain tube is connected at all times to the outside of the valve assembly 35 by virtue of the condensate outlet aperture 115 through the plug 113.

Figure 3:
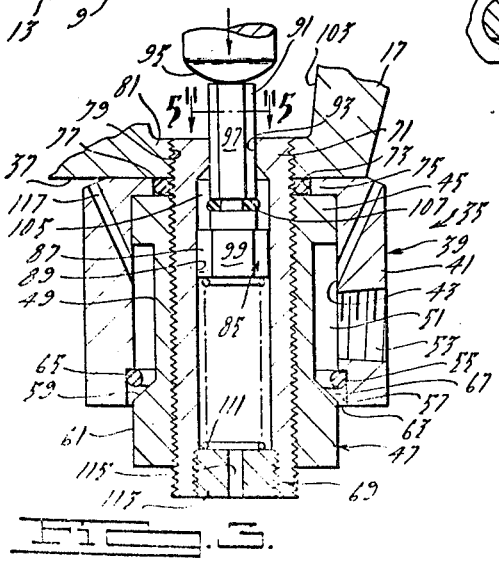
FIG. 3 is an enlarged view of the bottom end of the cylinder shown in FIG. 2 with the piston in down position and with the defrost and drain valve shown in cross section and in a condition in which water can pass through the valve to the outside thereof.

In operation, the admission of pressurized air to conduit 19 will cause a pressure build-up within the space 103 in end cap 17 that will begin to move the piston 23 and rod 25 upwardly from the position shown in FIG. 2 and FIG. 3. Such pressure will also flow for a brief period through the opening 101 (FIG. 5) into the chamber 105, across the flat 99, and out of the opening 115 until the rod 25 lifts high enough to enable the plunger 85 to reach approximately the top position of FIG. 4. Thus, the pressure air briefly blows out the valve 35 until sealed off by the O-ring 107 in opening 93.

As the piston 23 moves upwardly, air within the cylinder 15 on the top side of the piston will be compressed and forced to flow through the passage 29 into the exhaust conduit means 31. The compression raises the temperature of the air so that relative hot air passes through the conduit section 33 and into the chamber 51 inside of the valve body 39. The air flowing through the conduit means 31 will be at a pressure that is greater than atmospheric pressure and will therefore force valve member 65 to seat against the surface 59 and seal off the opening 63, as seen in FIG. 4. The only escape for the air reaching the chamber 51 is to flow out of a series of upwardly directed angular passages in the body 39 forming outlet ports 117. These ports open out of a conical top peripheral surface 119 on the body 39 and direct streams of relatively hot exhaust air against the bottom of the metal inlet air end cap 17 and therefore provide heat to the end cap. They also serve as air inlets on the return or down stroke of the piston 23. The exact location of the ports 117 depends to some extent on the exact shape of the end cap 17; and, in the arrangement shown, there are ports located as in FIGS. 3 and 4 along with two pairs of ports 117 located as in FIG. 2.

As the piston 23 moves up in the cylinder 15 and the compressed air in the space 103 and on the bottom side of the piston expands, the energy required for expansion has a tendency to lower the temperature of the surrounding environment. In the past this has resulted in the formation of frost or ice in and around cap 17 when the cylinder was operated at a high rate of speed. When this melted, water condensed inside of the end cap and under some conditions it could form ice and interfere with the operation of the cylinder and with the operation of the unloader 1. With the valve 35, heated exhaust air from the cylinder is supplied to counteract the cooling tendency of the expanding pressurized air and a drainage means is supplied to drain away water that may condense in space 103 inside of the end cap 17. It is noted that the water or foreign matter which may have accumulated inside of the space 103 or the drain tube 69 is blown out at the commencement of the pressure stroke of the cylinder. The net result is that the speed of operation of the unloader 1 can be increased substantially.

Referring now to FIGS. 6 to 11 for a modified form of the invention, a flow control valve 201 communicates by way of a nipple 203 with an exhaust passage (not shown) in an air cylinder 205 which may be used on a different type of press loader or for a different operation on an unloader, etc., the exhaust passage being comparable to passage 29. The cylinder 205 may be considered to be of a structure substantially the same as cylinder 15 but in this arrangement it is shown in a horizontal position so that its rod 207 reciprocates horizontally. The exhaust side of the piston connects by way of nipple 203 to valve 201 which connects by way of nipple 209 to fitting 211 and conduit 213 which may be exposed to atmosphere.

Figure 7:
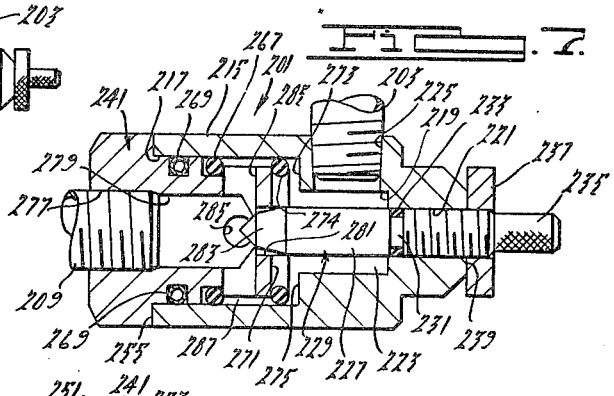
FIG. 7 is an enlarged cross section through a portion of the structure shown in FIG. 6.
Figure 8:
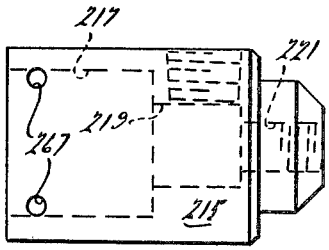
FIG. 8 is a side elevation of the valve body used in the flow control valve of FIGS. 6 and 7.
Figure 10:
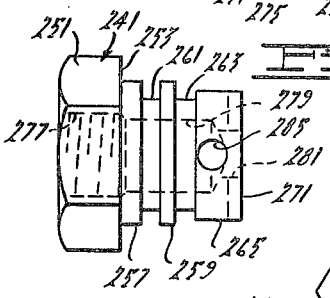
FIG. 10 is a side elevation of the end cap that is used with the valve body of FIGS. 8 and 9.

As seen best in FIGS. 7 and 8, the valve 201 has a cylindrical body 215 that has three aligned internal bore sections 217, 219, and 221 which together extend from one end of the body to the other and are respectively of gradually reducing diameters. The intermediate section 219 forms an inlet chamber 223 into which a threaded inlet aperture 225 opens and receives the nipple 203. Extending through the chamber 223 is the stem portion 227 of a manually operated valve 229 which is threadedly supported in the bore section 221. The valve member 229 has a reduced diameter section 231 which serves as a retainer groove for an "O" ring 223 that seals with an unthreaded inner end of the wall of the section 221. The outer end of the valve member 229 which is located outside of the body 215 has a knurled section 235 to enable it to be easily rotated by the fingers and an external washer 237 on the threaded section of the valve 229 which can be screwed up against the end 239 of the body 215 to hold the valve 229 in a selected axial position.

Figure 9:
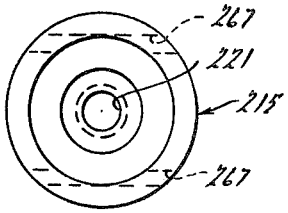
FIG. 9 is an end view taken from the left of FIG. 8.
Figure 11:
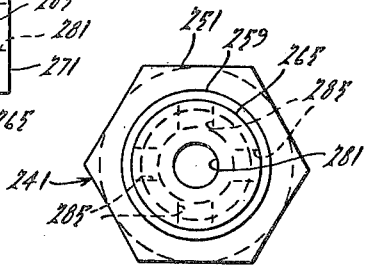
FIG. 11 is an end view taken from the right of FIG. 10.

A rotatable end plug 241 has a hexagonal torque receiving head section 251 with a bottom face 253 that engages the end surface 255 of the body 215. The end member 241 has a pair of cylindrical sections 257 and 259 that fit the porton 217 of the body 215 and are rotatable upon it. There is a reduced diameter annular section 261 between the diameters 257 and 259 for a purpose to be described later, and there is a reduced diameter section 263 between sections 259 and a cylindrical end section 265, which is somewhat smaller in diameter than section 265 but somewhat smaller than the section 259, to form a groove that receives an "O" ring seal 267 for sealing the member 241 with respect to the diameter 217. As best seen in FIGS. 8 and 9, the body 215 has a pair of straight-through transverse openings 267 formed in it which are in alignment with the reduced diameter section 261 of the member 241 when the latter is inserted all the way into the body. The holes 267, therefore, can receive roll pins 269 which fit in the section 261 and hold the member 241 in axial position within the body 215 while at the same time permitting it to rotate with respect to the body, thereby in combination with the hex head of member 241 eliminating the need for a special rotary coupling to connect conduit 213 to valve 201.

The end face 271 of the member 241 is spaced axially away from the shoulder 273 between body diameters 217 and 219. An "O" ring 274 having an inner diameter less than the outer diameter of the section 265 of member 241 and an outer diameter that corresponds to the diameter of body section 217 is positioned in the space 275 between the end 271 and the shoulder 273 to perform a valve function corresponding to that performed by the "O" ring valve member 65 in the valve 35.

The end member 241 has an opening extending through it from one end to the other which includes a threaded portion 277 in the head section 251, an intermediate diameter portion 279, and a small diameter portion 281 opening out of the end face 271. The conical innermost end 283 of the valve 229 seats on the edge of the opening 281 and the space between the conical face 283 and the edge of the opening 281 forms an annular metering orifice that regulates the rate of flow from the nipple 203 into the section 279 of the end cap 241 and therefore the rate of exhaust and the rate of piston movement on its power stroke for the cylinder 205.

A pair of cross holes 285 extending at right angles to the axis of the cap 241 connect the annular space 287 between the outer periphery of section 265 and the wall of diameter 217 with the inner diameter portion 279 of the member 241. When air under pressure flows into the inlet chamber 223, the "O" ring 274 will be forced against the end face 271 to seal off the passage 287. However, on the return stroke of the piston, air will be sucked into the right side of the cylinder 205 and it can flow through conduit 213 toward the valve 201 and pass into the nipple 209 that is threaded in section 277, into section 279 of the member 241, out through passages 285 into the annular space 287 to force the valve member 274 to move against shoulder 273 and permit a substantial amount of inlet air flow, in addition to that passing by the conical section 283 of valve member 229, to enable a fast return stroke of the piston and rod in the cylinder 205. The rate of movement of the rod 207 on the power stroke is clearly under complete control of valve member 229.

Figure 12:
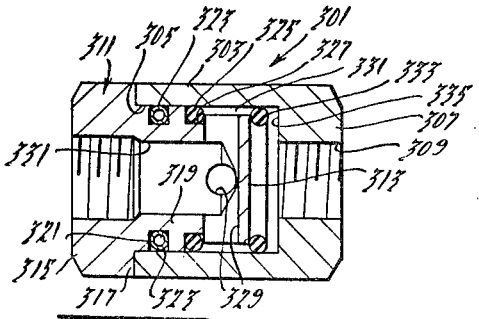
FIG. 12 is a longitudinal cross section through a check valve embodying the invention.
Figure 13:
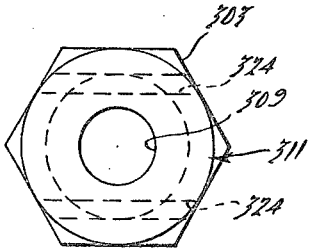
FIG. 13 is an end view taken from the right of FIG. 12.

Referring to FIGS. 12 and 13, a check valve 301 is shown that has structural features that are very similar to those already shown in the valve 201. It has a hex-shaped body 303 with a cylindrical bore 305 that corresponds to section 217 of the valve 201. The body 303 has an end wall 307 with a through opening 309 that may be pipe threaded to correspond basically to the opening 225 in the valve 201.

An end member 311 is substantially identical to end member 241, the only difference being the omission of the hole 281 so that the end member 311 has a solid end wall 313. The end member 311 has a hexagonal head 315 and it shoulders against the end 317 of the body 303. The internal portion 319 of the member 311 has an annular groove 321 to receive a pair of roll pins 323 that correspond identically to the roll pin arrangement 269 in the valve 201, which extend through transverse holes 324 in the body 303. The check valve 301 also has a valve member "O" ring 325 that seats in a groove 327 to correspond identically to the "O" ring valve member 267 and the diameter 263 of the valve 201. Further, there are cross passages 329 which connect the annular space 331 between the portion 319 and the diameter 305 with the inner diameter 331 on the member 311. An "O" ring 333 floats between the end face 313 and the radial shoulder 335 in the body 303 to function in the same way as "O" ring 274 of valve 201.

Thus, in operation, as a check valve, air, liquid or gas can flow from right to left through the check valve 301 but there can be no flow from left to right because that will seat the valve member 333 against the end face 313. Because the end member 311 can rotate with respect to the body 303, rotatable couplings normally required to connect flow conduits to the valve 301 are not required and the hex shape of the parts permits them to be wrench tightened to conduit fittings.

Modifications may be made in the specific structures that have been described and illustrated without departing from the spirit and scope of the invention.

I claim:

1. In a press unloader or the like having a gravity return air pressure cylinder arranged so that the piston and rod move in a vertical upward direction on the power stroke and having a pressure air inlet at the bottom end of the cylinder including a portion in which condensate collects, a valve assembly having a first opening communicating with atmosphere, said assembly having a second opening and an internal chamber connecting the first and second openings for air flow between them, conduit means connecting the second opening to the air cylinder on the side of the piston remote from the pressure air inlet so that exhaust air from the cylinder on the power stroke of the piston and rod flows into the conduit means, said valve assembly including a valve member for controlling the flow of air between the first and second openings and therefore through the conduit means, said valve assembly including a condensate collecting chamber and a plunger in said chamber arranged for movement in a vertical direction, said valve assembly being mounted adjacent the pressure inlet of the air cylinder and so that said plunger is in alignment with the bottom of the piston rod and engageable by said piston rod at a vertical level adjacent to but above the bottom end of the stroke of the piston rod, said valve assembly having an outlet from said condensate collecting chamber for the flow of condensate to atmosphere, said plunger projecting into a condensate collecting portion of the pressure air inlet of said cylinder and forming a part of a condensate flow passage means connecting the air inlet to said condensate collecting chamber, means associated with movement of the plunger for sealing off said condensate flow passage when the piston rod has moved vertically beyond a predetermined elevation and for opening said flow passage when the piston rod is below a predetermined vertical elevation.

2. In a press unloader as set forth in claim 1, a valve assembly wherein a plurality of air flow passages located to project air streams against the outer surface of the inlet end of the air cylinder are provided and serve as outlet passages for exhaust air flowing into said chamber through said conduit means.

3. In a press unloader as set forth in claim 2, said valve assembly having a drain tube that is externally threaded and extends into a threaded opening in the bottom of the air cylinder inlet to provide means for attaching the assembly to the air cylinder.

4. In a press unloader as set forth in claim 3, a valve assembly wherein said plunger fits inside of said threaded drain tube and said condensate collecting chamber is formed inside of said drain tube.

5. In a press unloader as set forth in claim 4, said valve assembly including an outer body having said plurality of air flow passages therein, a spool inside of said body and threaded onto the outside of said drain tube, said spool having a reduced diameter section cooperating with the inside of said body to form said internal chamber, said plurality of air flow passages opening into said internal chamber.

6. In a press unloader as set forth in claim 5, a valve assembly wherein said spool extends through an open end of said body and forms, with said open end, said first opening and also a valve chamber, and an annular axially movable valve element in said valve chamber providing said valve member.

7. In a press unloader as set forth in claim 5, a valve assembly wherein said plunger is generally circular in cross section but has a flat surface along one side and extending axially along the plunger to form a side of said condensate flow passage means, said plunger extending through a circular opening in said drain tube and carrying an annular seal that engages the wall of said last mentioned opening to form a condensate blocking seal when the plunger is in substantially its uppermost postion and moves away from said opening wall when the plunger is depressed by the piston rod substantially below said uppermost position.

8. An anti-frost and drain valve for connection to the air inlet end of a pressure air cylinder containing a piston and rod comprising a body having a central opening extending through it, a spool having an end portion fitting said opening and a reduced diameter portion forming with the wall of said opening an internal chamber, said body having a shoulder at one end in said opening and said spool being seated against said shoulder, the other end of said spool being spaced from the other end of said opening to provide an air inlet to said chamber, valve means operated by above atmospheric pressure in said internal chamber to close said inlet, a port in said body opening into said internal chamber and providing means to receive a conduit for connection to the exhaust side of said air cylinder, a plurality of passages in said body providing outlets from said internal chamber and disposed to direct streams of air from said chamber against the inlet of the air cylinder, a drain tube inside of said spool and threadably connected to it and extending beyond the end of the body to provide a means for attaching the body and spool to the inlet end of the air cylinder, said drain tube having an internal bore of circular cross section providing a condensate collecting chamber, said drain tube having a reduced diameter opening in alignment with and connected to said bore and of circular cross section, a plunger having a non-circular head disposed in said bore and a non-circular stem disposed in said last mentioned opening and extending beyond the end of the drain tube for contact with and depression by the rod of the cylinder, spring means in the bore urging the plunger to an extended position outwardly of the drain tube and into contact with the rod, and seal means carried by said plunger to block flow through said reduced diameter opening when the plunger is in its most outwardly extended position.

* * * * *